United States Patent [19]

Roca Nierga

[11] Patent Number: 4,561,398

[45] Date of Patent: Dec. 31, 1985

[54] INJECTION PUMP REGULATOR SYSTEMS FOR INTERNAL COMBUSTION ENGINES

[75] Inventor: Manuel Roca Nierga, Leghorn, Italy

[73] Assignee: Spica S.p.A., Leghorn, Italy

[21] Appl. No.: 619,176

[22] Filed: Jun. 11, 1984

[30] Foreign Application Priority Data

Jun. 14, 1983 [IT] Italy ..... 21616 A/83

[51] Int. Cl.[4] ..... F02M 41/00

[52] U.S. Cl. ..... 123/449; 123/503; 417/289

[58] Field of Search ..... 123/449, 450, 503; 417/289, 282, 294

[56] References Cited

U.S. PATENT DOCUMENTS

| | | | |
|---|---|---|---|
| 2,980,092 | 4/1961 | Dreisin et al. | 123/449 |
| 3,421,486 | 1/1969 | Parrish, Jr. | 123/449 |
| 3,758,241 | 9/1973 | Eheim | 123/449 |
| 3,999,529 | 12/1976 | Davis | 123/449 |
| 4,376,432 | 3/1983 | Davis | 123/450 |
| 4,478,187 | 10/1984 | Yamada | 123/449 |

FOREIGN PATENT DOCUMENTS

| | | | |
|---|---|---|---|
| 3014028 | 10/1981 | Fed. Rep. of Germany | 123/449 |

*Primary Examiner*—Magdalen Y. C. Moy

*Attorney, Agent, or Firm*—Diller, Ramik & Wight

[57] ABSTRACT

A fuel injection pump, particularly of the distributor type in which a piston is driven with reciprocating and rotary motion in order to effecting a combined action of pumping and distribution to the various cylinders of the internal combustion engine associated therewith, comprising a regulation control unit which receives signals as a function of which the pump throughput is to be varied, and which by means of an actuator correspondingly controls the movement of a delivery control element. Said control element consists of an annular valve traversed by the injection pump piston and axially constrained with respect to the casing of said pump, but able to rotate by means of a helical gear—worm gear device in order, as a function of its angular movement controlled by the actuator, to cause the uncovering, by at least one oblique slot provided on the inner diameter of said valve and emerging at least one flat face thereof, of at least one bore of a plurality of discharge bores present on the outer surface of the piston and connected to the pump pressure chamber. The instant of termination or initiation of the injections is thus determined, together with the quantity of fuel delivered.

6 Claims, 6 Drawing Figures

INJECTION PUMP REGULATOR SYSTEMS FOR INTERNAL COMBUSTION ENGINES

This invention relates to a regulator device for the quantity of fuel delivered by an injection pump associated with an internal combustion engine. The device is particularly suitable for control by electronic control means.

With fuel injection pumps there must be associated a control device which regulates the fuel delivery as a function of the position of a control member positioned by the operator, and of the rate at which the pump is operating.

This control device is commonly known as a speed regulator, and is mostly constructed on mechanical or hydraulic principles. Certain drawbacks are however associated with these types of regulator. The main drawback is the timing delay due to the regulator frequency characteristics and the inertia of the injection pump control members. Moreover, complicated devices have to be added in order to perform other auxiliary functions (torque correction, maximum throughput limitation in accordance with the booster feed pressure, excess fuel or starting, etc.).

To obviate these drawbacks, and to obtain a regulating accuracy which satisfies the rigorous exhaust emission requirements, various types of electrically or electronically controlled regulators have appeared in recent years, and which by acting on suitable actuators enable complicated regulation programs to be fulfilled, such as those required by diesel engines when used in automobiles.

In the particular case of distributor injection pumps of the type in which a single pumping element is driven with reciprocating and rotary motion in order to effect a combined pumping and distribution action, regulation of the injected fuel quantity is normally effected, in known manner, by the axial movement of a control valve cooperating with one or more discharge bores present in the pumping element piston.

In electronic regulators proposed for this type of pump, the same control system has been used by axially moving the regulator valve by means of an eccentric spindle coupled to a rotating magnet (GB Patent 2.034.400 A) or a pivoted lever cooperating with the threaded shaft of a D.C. motor (GB Patent 2.073.448 A). However, using a control system involving the axial movement of the valve gives rise to disturbing forces which influence the regulator to the extent of limiting the degree of accuracy obtainable by the use of electronic systems. In this respect, the reciprocating and rotary movement of the pumping piston gives rise to drag forces on the regulator valve due to the viscosity of the liquid disposed between the piston surfaces and the valve, and the very small clearance between these two components in order to obtaining high pressure sealing. It is apparent that of the two drag forces, namely the rotary and the axial, it is this latter which causes most disturbance to the regulator because by acting coplanarly with the regulating force it tends either to oppose or to supplement this latter force in frequency with the reciprocating motion of the piston. This axial force alternation thus tends to destabilise the regulator by causing it to oscillate about its equilibrium position. This oscillation is more harmful the shorter the regulation stroke of the valve. Even in those cases in which the irreversibility of the mechanism prevents the drag forces on the valve from directly influencing the electronic control device (GB Patent 2.073.448 A), the alternation of these forces still leads, even though to a lesser extent, to a corresponding movement of the valve within the limits of the slack existing in the linkage which connects to the actuator.

Towards the sixties some systems were proposed for regulating the distributor injection pumps (U.S. Pat. No. 2,980,092 and FR 1.394.674) which provided the use of a control valve with rotating motion which, tightly sliding on the piston of the pump, selectively closed a conduit connected with the pumping chamber of the same for determining the active stroke of the said piston and therefore the quantity of injected fuel.

Such systems reduced the influence of the alternation of the axial forces on the regulating element but, due to the control system and to the mechanical realisations adopted, did not allow the consequent advantages to be exploited. The precision of the control was indeed limited by the presence of a mechanical control device which, directly or by means of a centrifugal regulator, defined the angular positioning of the throughput regulation element. In correspondance of the linkings or of the connecting levers between the control and the regulation device, still more numerous in the presence of an automatic control device (FR 1.394.674), slacks arose indeed, which reduced appreciably the precision of the system.

In order to evaluate the importance of such slacks it will be enough to consider that, under normal operating conditions, a so small circumferential slack between the end control lever and the regulating valve as 0.05 mm only, can result in an error difference of more than 5% of the maximum throughput.

The sensibility of the system is moreover reduced by the fact that in the rotary regulation systems according to the mentioned patents, the longitudinal slot, or slots, provided on the piston or on the control valve for cooperating with one, or more than one, discharge bores, run parallel to the longitudinal axis of the pumping device.

Other characteristics, which are negative in regard to the precision of the control system, to be found, separately or jointly, in the presently known strucures are:

(a) The presence, in the region of the piston cooperating with the control valve, of only one radial discharge bore.

Such structure results in a large lateral force on the said control valve, during the pumping stroke of the piston, thus generating a rotary drag action on the valve by the piston itself. That disturbance action consequently appears again, as of a rotary character and then even so less noxious in that of a non oscillating character, which could be eliminated by the non-use of the control system of the displacement type.

(b) The lack, on the same control valve, of an adjustable ledge suitable for precisely defining the maximum fuel delivery.

According to the presently known technique such ledge is placed in the interior of the regulating group and as a result, the harmful slacks are still present in the connecting levers.

(c) The use of a single conduit both for loading and unloading the pump chamber.

This structure causes the partial resuction, by the pumping element, of the excess fuel discharged during the preceding compression stroke. This share of the fuel usually contains emulsions and vapours resulting from the high discharge speeds and can therefore negatively affect the filling ratio of the chamber, and then, once more, the precision degree of the metering action of the quantity of fuel delivered by the injection pump.

(d) The outlet of the discharge (and suction) bores on the outside circular surface of the control valve.

Such positioning causes, in some cases, the need to resort to complex and expensive processes for manufacturing the control valve, which consists of many components, successively assembled in a single complex structure.

General object of the present invention is avoiding the drawbacks said, in order to better exploiting the precision degree allowed by the use of the electronic control devices and by the use of a regulating system of the rotary valve type, inherently free from perturbations due to the reciprocating motion of the pumping piston.

To this purpose, according to the present invention a fuel injection pump is provided, in particular of the distributor type, in which a reciprocating piston connected to a pressure chamber of the pump provided with reciprocating and rotary motion in order to effect a combined action of pumping and distribution to the various cylinders of the internal combustion engine associated thereto, of the type comprising an electronic control group of the regulation, which receives the signal as a function of which the delivery capacity of the pump must be changed and which correspondingly operates, by means of an actuator, consisting of a stepping motor, or of a servo-controlled motor, the displacement of a control element of the delivery provided of an information feedback device, such control element of the delivery consisting of an annular valve having at least one slot on its inner diameter cooperating with a plurality of discharge bores realized on the outer surface of the piston and connected with the pressure chamber of the pump, such annular valve being traversed by the said piston and being axially constrained with respect to the casing of the said pump, but able to undergo angular movements controlled by the said group and executed by the said actuator for placing the said at least one slot in a position such to involve the region swept by at least one bore of the said plurality of discharge bores in a part of the pumping stroke of the said piston and thus define the length of the active stroke of the piston during which fuel is sent to the injectors and, consequently, the quantity of delivered fuel, such a pump being characterized in that said at least one slot placed on the inner diameter of the annular valve runs obliquely relatively to the axis of the said valve and emerges on at least one flat face of the valve itself and that the transmission mechanism of the motion from the actuator to the rotary annular valve consists of a helical gear-worm gear system, the said helical gear of the said system being formed by the said regulation annular valve itself by means of a partial toothing provided on its outer circular surface on which moreover a radial sledge plane is formed cooperating with an adjustment screw rigid with the casing of the said pump in order to defining the maximum angular displacement of the said regulating annular valve and, consequently, the maximum delivery of the injection pump.

As it can be seen from the characteristics above set forth and by a further examination of the attached claims, the pump constructed within the spirit of the present invention is expected to increase, in comparison to the technique known from the prior art, the precision of the regulation system by resorting to such structural realizations as to allow the presence to be eliminated of slacks between the control and the regulation elements and by reducing the ratio, and thence the sensibility, of the delivery changes to the angular rotation of the regulating annular element.

The use of a helical gear-worm gear system as the transmission mechanism of the motion from the electrical actuator to the rotating annular valve and the forming on the peripheral surface of such valve, of the toothing forming the said helical gear allow indeed that a direct device be realized characterized by extremely reduced slacks. Such slacks moreover can be completely eliminated by means of the use of a volute or of a spiral spring, as it will be shown hereinafter.

The presence of an adjusting screw directly active on the annular valve for limiting its maximum angular displacement, allows moreover to obtain a precise definition of the maximum quantity of fuel delivered by the injection pump.

The reduction of the sensibility between the changes of the delivery rate and the angular displacements of valve is obtained on the contrary, by obliquely orienting, with respect to the axis of the pump, the slot, or the slots, formed on the inner diameter of the annular valve. To the purpose of increasing the precision of the system, it will be advisable to have these slots as inclined as it will be allowed by the functional geometry of the pump.

Within the spirit of the present invention, moreover, such slot emerges on at least one of the two flat surfaces of the annular valve without involving the outer circular surface of it. When doing so, the necessity is avoided of resorting, as on the contrary it was needed according to some structures of the prior art, to complex structures of the regulating valve, consisting of a plurality of components.

The plurality of the discharge bores formed on the piston secures moreover the balancing of the forces exerted by the pressure of the fuel on the control annular element, avoiding that a notable rotary drag action of the said control element by the pumping piston can take place.

The provided presence of an information feedback device to the electronic control group monitoring the instantaneous position assumed by the regulation valve and the separation of the feeding loop of the pumping chamber from the discharge conduits of it, finally confer a further increase of the metering precision of the fuel to the system.

The structural and operational characteristics of the invention and its advantages over the known art will be more apparent from the description given hereinafter by way of example with reference to the accompanying diagrammatic drawings, in which.

Figure 1:
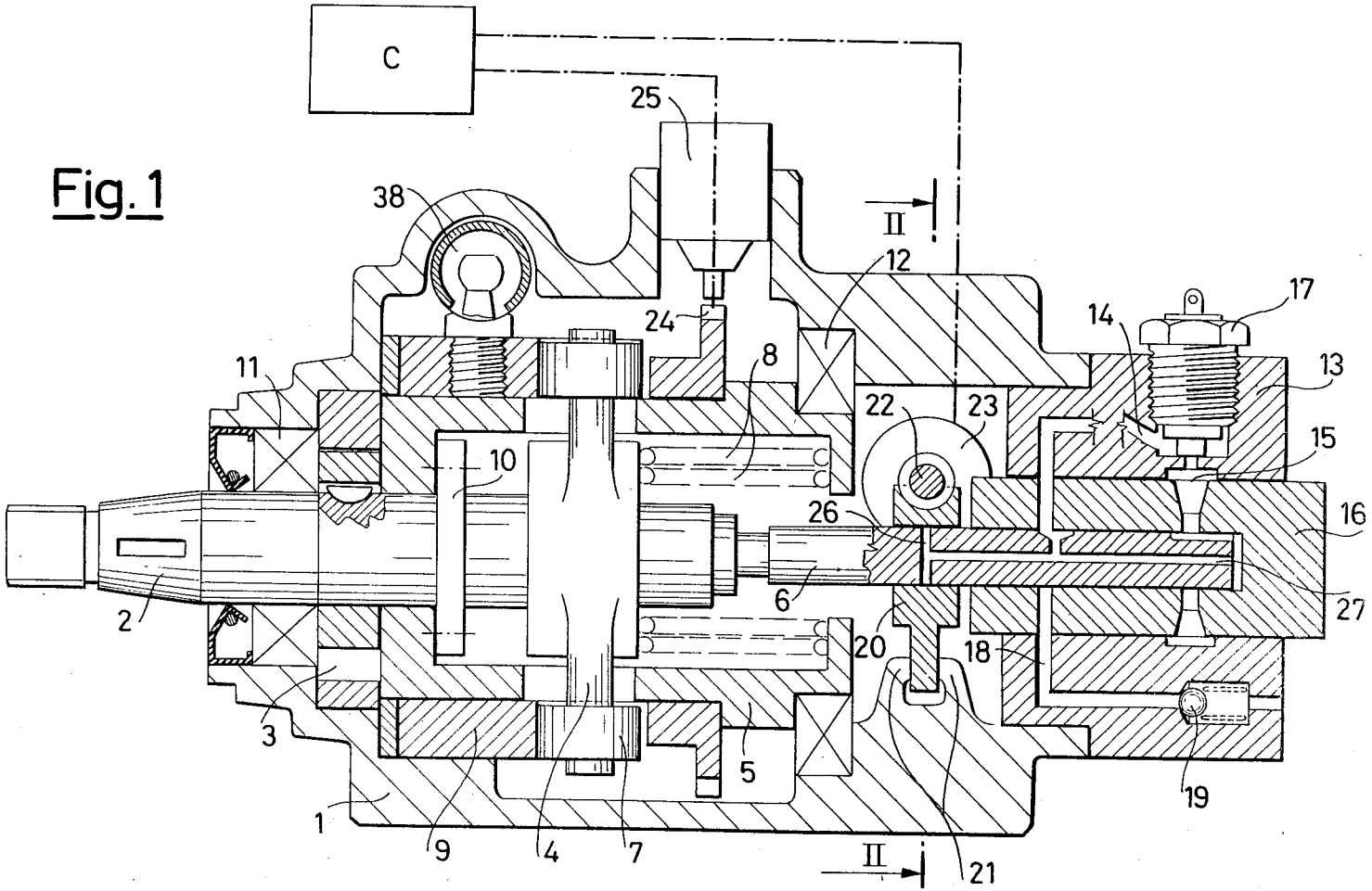
FIG. 1 is a longitudinal section through a possible embodiment of a distributor pump with throughput regulation effected in accordance with the principles of the invention.

With reference to FIG. 1, the casing 1 of a distributor injection pump contains a drive shaft 2 which is connected to the internal combustion engine to rotate the injection pump feed pump 3, the roller support spider 4, the spring support cup 5 and the pumping element piston 6. The spider 4, provided with rollers 7, is pressed against the lobe ring 9 by the springs 8 which react against the cup 5, and thus in rotating in phase with the shaft 2 undergoes a reciprocating axial movement which is transmitted to the piston 6 to effect the fuel intake and pumping stages. The rotary control unit, which is made rigid by the connection between the flange 10 of the shaft 2 and the base of the cup 5, is supported by the support bearings 11 and 12 which are located at the two opposite ends of said unit to prevent cantilever operation.

The injection pump hydraulic head 13 comprises the duct 14 which is connected to the pump 3 to feed the feed ducts 15 of the cylinder 16 at a pressure which increases as the engine rotational speed increases. A cut-off electromagnet 17 interrupts connection between the ducts 14 and 15 if the engine has to be stopped. During the rotation of the piston 6, the distribution channels present thereon alternately connect the pumping element pressure chamber to the delivery ducts 18, each of which is associated with a valve 19 and an injector unit, not shown.

The interior of the pump casing 1 is completely flooded with low-pressure fuel, which both cools and lubricates the mechanical units contained therein.

The piston 6 cooperates moreover in its most far region from the pressure chamber with the regulation valve 20 axially constrained between the extensions 21 rigid with the pump casing, but actuated to rotate, within the spirit of the invention, by means of the gear-worm gear 22 controlled by the electrical actuator 23.

The injection pump of FIG. 1 also comprises a speed sensor formed by the toothedwheel 24 rigid with the cup 5, and the detector 25, to provide the central electronic control unit, indicated diagrammatically by C, with the information relative to the speed of rotation of the pump.

The injection apparatus is completed by an advance variation device 38 which in known manner displaces the cam ring 9 in order to varying the timing between the pump and engine in accordance with the operating conditions of this latter.

Figure 2:
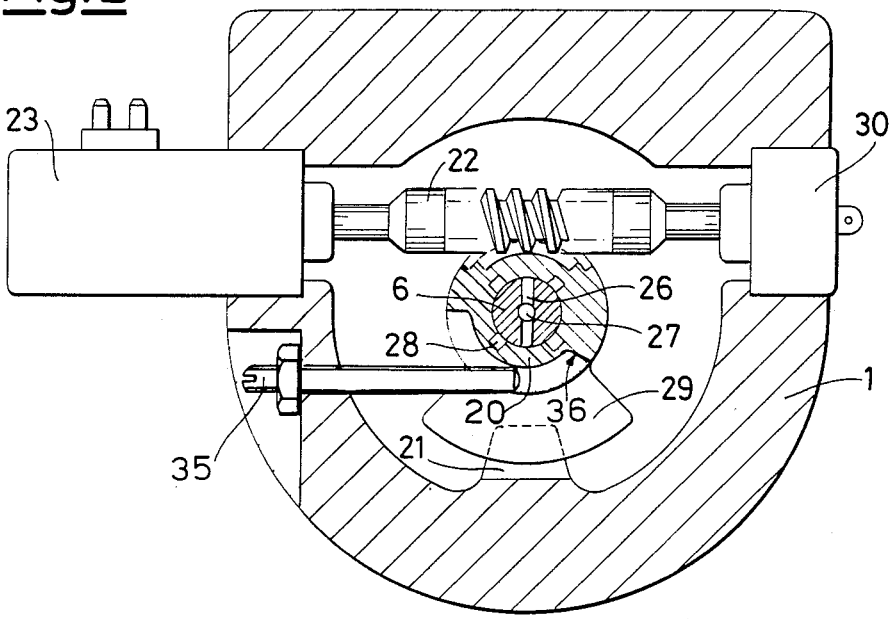
FIG. 2 is a cross section through the distributor pump on the line II—II of FIG. 1.

The regulator valve operating system is shown in FIG. 2.

The electric motor 23, of the servo-controlled or stepping type, receives control pulses from the central electronic unit, and by way of the spindle 22 and worm causes the regulator valve 20 to rotate in order to move it into the position corresponding with the required delivery condition. An information feedback signal regarding the angular position of the regulator valve can be provided to the central electronic unit by the multi-revolution potentiometer 30 mounted coaxially with the electric motor 23 and with the drive spindle 22.

On rotating, the valve 20 varies the instant at which the piston transverse bore 26, connected to the pressure chamber by the longitudinal bore 27, becomes uncovered by the slots 28 with which the valve is provided.

A more complete and detailed operational description of the regulator system using the angularly mobile valve is given hereinafter.

FIG. 2 also shows the lug 29 which cooperates with the appendices 21 rigid with the pump casing 1 to axially constrain the control valve 6 but allow it to rotate.

An end of stroke reference can be obtained by means of the adjusting screw 35 which, cooperating with the ledge 36 positioned on the regulation valve, defines the maximum quantity of fuel delivered by the injection pump.

Figure 3:
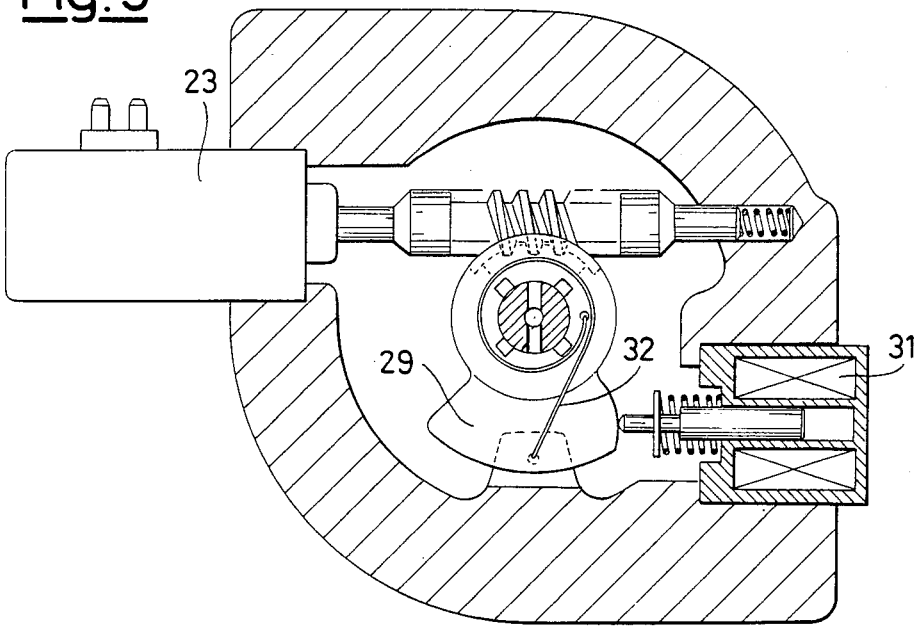
FIG. 3 is a possible modification of FIG. 2.

FIG. 3 shows a possible modification of the device illustrated in FIG. 2. In place of the multirevolution potentiometer, the feedback information to the central electronic unit regarding the angular position of the regulator valve is provided by the linear transducer 31 which rests against the side of the lug 29. The spiral spring 32 ensures complete take-up of the slack between the two components of the gear-worm system in order to improving regulation accuracy.

Figure 4:
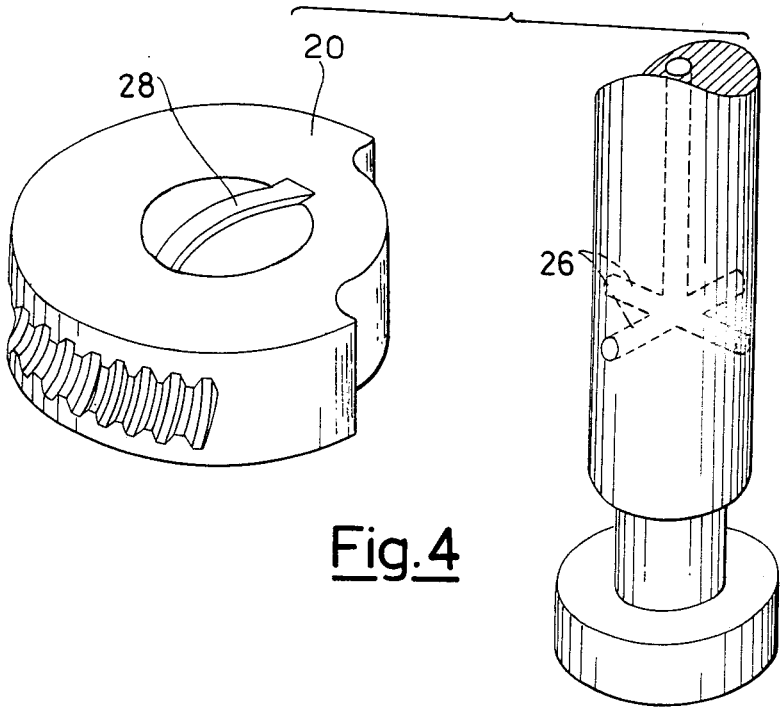
FIG. 4 is a perspective view of a possible embodiment of the rotary piston and of the regulation valve realized according to the principles of the invention.

In FIG. 4 a perspective view is given of the embodiment of the piston-valve unit realized according to the principles of the present invention.

The unit shown in FIG. 4 comprises only one discharge slot 28 facing a plurality of bores 26, which are provided in the same number as the cylinders of the engine with which the pump is associated.

As it can be seen, the pump shown in FIG. 4 is provided, on its outside periphery, both with the toothing of the helical gear and a cylindrical housing and a ledge plane for the above described control system of the maximum quantity of fuel delivered by the injection pump.

Figure 5:
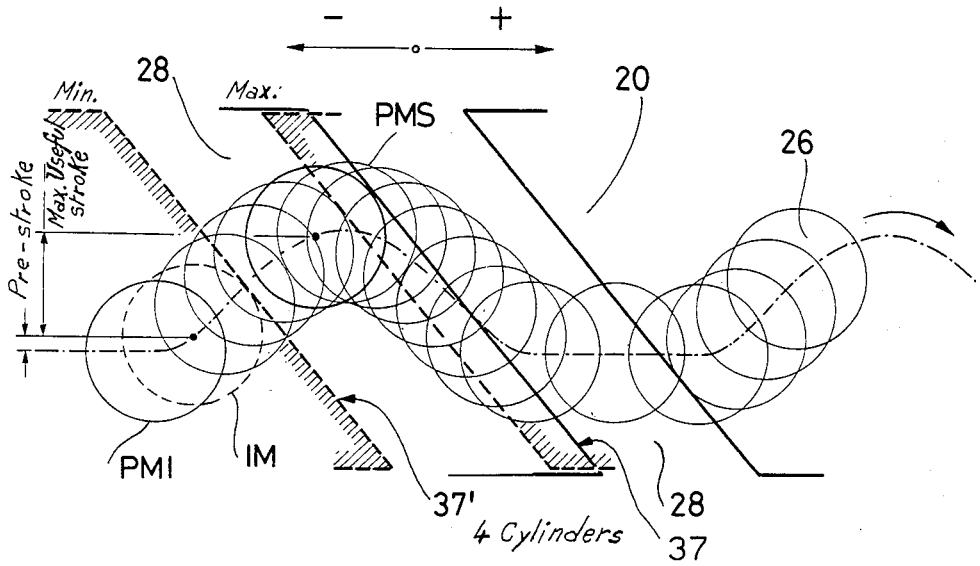
FIG. 5 shows the successive positions of a discharge bore relative to the oblique slots of the regulator valve during the reciprocating and rotary motion of the pumping piston.

The method of operating of the angularly mobile regulator valve is better apparent from the diagram of FIG. 5, which shows the successive positions of a piston discharge bore 26 relative to a slot 28 provided on the inner diameter of the valve. These successive positions of the bore 26 are originated by the reciprocating and rotary movement of the pumping piston (6 of FIG. 1). The commencement of the pumping stage is determined in known manner, on termination of a defined "pre-stroke", by the covering, due to the axial movement of the piston, of a discharge duct which connects the pumping element pressure chamber to the pump feed chamber. At this instant, the bore 26 assumes the dashed-line position indicated by I.M. (delivery commencement) in FIG. 5.

As the piston movement proceeds, the bore successively assumes the various positions indicated in FIG. 5, until at the end of the delivery stroke it reaches the position indicated by P.M.S. (top dead centre). During this stroke, the pumping stage terminates when the edge of the discharge bore 26 passes beyond the cooperating edge 37 of the oblique slot 28 present on the regulator valve 20, to thus discharge the pumping element pressure chamber, to which it is connected by the longitudinal bore 27 (FIG. 1).

It is therefore apparent that on rotating the regulator valve 20, the useful delivery stroke of the pumping element varies, with a consequent variation in the injected fuel quantity. By way of example, in the two different valve positions shown in FIG. 5, the delivery obtained is respectively zero when the edge of the discharge slot indicated by 37′ by means of a dashed line is already tangential to the bore 26 when in its delivery commencement position (I.M.), and maximum when the tangency condition is attained for a bore position (shown more heavily) very close to the top dead centre, with the edge in the position 37 shown by means of a full line.

Figure 6:
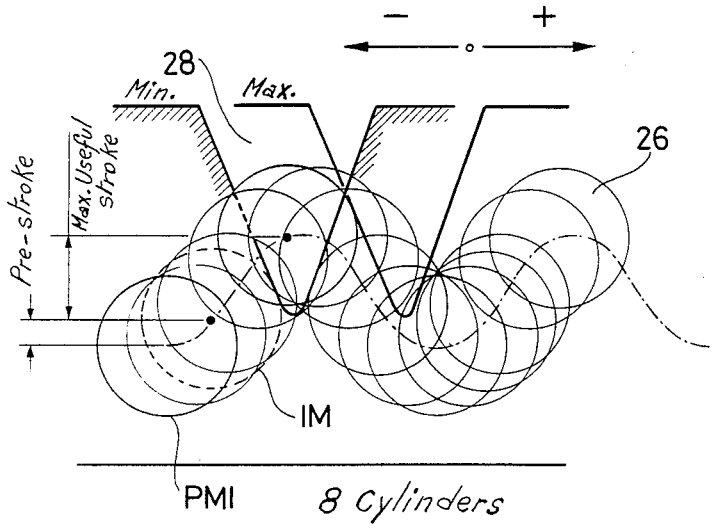
FIG. 6 is a modification of FIG. 5 showing a particular slot form which is valid for 8-cylinder injection pumps.

In order to enable the invention to be also used for those types of distributor pump in which the various operating positions of the discharge bore 26 are closer together because of the large number of engine cylinders, the discharge slots 28 can be provided in different forms (FIG. 6) so that although ensuring normal operation of the system they do not interfere with the successive piston delivery stroke.

As it has already been mentioned, the discharge slots provided on the inner diameter of the regulator valve could also extend exactly longitudinally, i.e. parallel to the pumping element axis, but the throughput variations in such a case would be more sensitive to the angular position of the valve. Consequently, in order to improving regulation accuracy, it is advantageous to incline said slots to the maximum amount allowed by the pumping element geometry.

It should also be noted that as the discharge section is completely separate from the intake section in the present invention, the rotation of the regulator valve does not present any obstacle to the filling of the pumping element, in contrast to the known art. In fact, the partial uncovering of the discharge bore 26 during the intake stroke (FIG. 5) leads to the cooperation of at least one of the discharge bores under normally critical filling conditions, this bore then allowing the fuel contained under pressure in the pump casing to be fed during said stroke.

Finally, the provision of an advance variator unit acting in known manner on the positioning of the cam ring 9 (FIG. 1) obviates the defect, present in some of the cited patents, of the injection rate varying as the advance varies.

For correct operation of the proposed rotary valve regulator device, the control program memorised in the central electronic unit must also take account of the instantaneous position of the cam ring, because the variation in the commencement of delivery by means of the variator 38 in order to changing the timing between the injection pump and the engine associated with it, leads to a corresponding variation in the injected fuel quantity for equal valve positions. For greater control accuracy, the information relating to the cam ring position can be provided by means of a displacement transducer. It should be noted that in the aforegoing description of the structural and operational characteristics of the invention, the type of throughput regulation considered has been that most commonly used in injection pumps, i.e. in which the commencement of delivery is constant and the termination of delivery varies as a function of the throughput delivered by said pump. However, the type of regulation comprising variable commencement and constant termination also falls within the range of application of the invention. In such a case, the rotation of the regulator valve varies the instant of covering of the piston transverse bore 26 during its delivery stroke. Termination of the pumping stage is determined by the constant uncovering of a discharge bore which connects the pumping element pressure chamber to the pump feed chamber during the axial movement of the piston 6.

In practice, with reference to FIG. 5, the edge 37 can likewise have a range of movement which involves the bore 26 in its movement from the bottom dead centre to a successive position, which varies as the movement of the element 20 and thus of the slots 28 varies. Thus in this case the initial part of the piston stroke is inactive, and the subsequent part towards the top dead centre, when the bore has completely passed beyond the slot, constitutes the active part of said piston stroke.

I claim:

1. Fuel injection pump comprising a piston (6) movable in a pressure chamber of a casing (1) of the pump, means for imparting reciprocating and rotary motion to said piston in order to effect a combined action of pumping and of distribution to associated cylinders of an internal combustion engine, electronic means (c) for controllably regulating the throughput of the pump and through an actuator (23), controls the displacement of a fuel delivery control element (22), information feedback means (30, 31) responsive to said control element in the form of an annular regulation valve (20) having at least a slot (28) on its inner diameter cooperating with a plurality of discharge bores (26) formed on the outer surface of said piston (6) and connected with said pump pressure chamber, said annular valve 20 being traversed by said piston (6) and being generally axially constrained with respect to said pump casing (1) but capable of angular movement by the said actuator (23) for placing said at least one slot (28) in fluid communication with at least one of said plurality of discharge bores (26) to share the pumping stroke of said piston (6) and thus to determine the length of the active stroke of the piston (6) during fuel delivery, said at least one slot (28) on the inner diameter of the annular valve (20) runs obliquely with respect to the axis of said valve (20) and emerges on at least one planar face of said valve (20) said control element (22) being formed by a helical gear in mesh with a worm gear, said helical gear being defined by said regulation annular valve (20) in the form of a partial toothing of its outer circular surface, said regulation annular valve (20) having a radial ledge (36) cooperating with an adjustment screw (35) for effecting the maximum angular displacement of said regulation annular valve (20) and, consequently, the maximum delivery of the injection pump.

2. Injection pump as claimed in claim 1, characterized in that the information feedback means is a potentiometer of the multi-revolution type (30) connected to a spindle of the actuator (23).

3. Injection pump as claimed in claim 1, characterized in that the information feedback means is a linear displacement transducer (31) supported by an appendix (29) of said valve (20).

4. Injection pump as claimed in the claims 2 or 3, characterized in that said annular regulation valve (20) cooperates with elastic means (32) for eliminating slack motion between the actuator (23) and said valve (20).

5. Injection pump as claimed in claim 4, characterized in that said elastic means (32) is a volute spring acting on the regulation valve (20).

6. Injection pump as claimed in claim 4, characterized in that said elastic means (32) is a spiral spring acting on the regulation valve (20).

* * * * *